US009836004B2

(12) United States Patent
Oikawa et al.

(10) Patent No.: US 9,836,004 B2
(45) Date of Patent: Dec. 5, 2017

(54) PRESSURIZING DEVICE, IMAGE FORMING APPARATUS, AND CONTROL, METHOD FOR PRESSURIZING DEVICE

(71) Applicants: Ken Oikawa, Kanagawa (JP); Minoru Takahashi, Kanagawa (JP)

(72) Inventors: Ken Oikawa, Kanagawa (JP); Minoru Takahashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/209,881

(22) Filed: Jul. 14, 2016

(65) Prior Publication Data

US 2017/0031294 A1 Feb. 2, 2017

(30) Foreign Application Priority Data

Jul. 27, 2015 (JP) ..... 2015-147987

(51) Int. Cl.
*G03G 15/00* (2006.01)
*G03G 15/16* (2006.01)

(52) U.S. Cl.
CPC ..... *G03G 15/6529* (2013.01); *G03G 15/167* (2013.01); *G03G 15/168* (2013.01)

(58) Field of Classification Search
CPC . G03G 15/6529; G03G 15/167; G03G 15/168
USPC ..... 399/66, 67, 68, 322, 328
See application file for complete search history.

(56) References Cited

U.S. PATENT DOCUMENTS 5,729,788 A * 3/1998 Hirohashi ..... G03G 15/167 399/101
2009/0279912 A1* 11/2009 Jones ..... B41J 2/0057 399/66
2010/0034565 A1 2/2010 Ashikawa et al.
2012/0072015 A1 3/2012 Takahashi
2013/0121715 A1 5/2013 Ashikawa et al.

FOREIGN PATENT DOCUMENTS

JP H05-289569 11/1993
JP 2009-276383 11/2009
JP 2010-151983 7/2010
JP 2014-038201 2/2014
JP 2016-001299 1/2016
JP 2016-136241 A 7/2016

* cited by examiner

*Primary Examiner* — Sandra Brase
(74) *Attorney, Agent, or Firm* — Harness, Dickey & Pierce, P.L.C.

(57) ABSTRACT

A pressurizing device includes: first and second rollers that holds a sheet-like medium with an image bearer formed on at least part of a surface of thereof between the first and second rollers and send the medium in a conveying direction while applying a pressure to the medium; a position control unit that performs feedback control of the position of at least one of the first and second rollers; a force control unit that performs feedback control of a force acting on between the first and second rollers; and a control-method switching unit that switches, after the position of the first and second rollers is switched from a separation position to a contact position by the feedback control performed by the position control unit, a feedback controlled object so that the force becomes a target value of nip pressure through the feedback control performed by the force control unit.

14 Claims, 13 Drawing Sheets

```
double average(double in)
{
 static double d[10] = {0};
 static int index=0;
 d[index++%10]=in;

 double sum = 0;
 for(int i=0; i < 10; i++)
 {
   sum += d[i];
 }
 return sum / 10;
}
```

PRESSURIZING DEVICE, IMAGE FORMING APPARATUS, AND CONTROL, METHOD FOR PRESSURIZING DEVICE

CROSS-REFERENCE TO RELATED APPLICATIONS

The present application claims priority under 35 U.S.C. §119 to Japanese Patent Application. No. 2015-147987, filed Jul. 27, 2015. The contents of which are incorporated herein by reference in their entirety.

BACKGROUND OF THE INVENTION

1. Field of the Invention

The present invention relates to a pressurizing device, an image forming apparatus, and a control method for the pressurizing device.

2. Description of the Related Art

Conventionally, image forming apparatuses using an intermediate transfer body, such as a tandem color image forming apparatus, have a problem that in the event of a change in the speed of the intermediate transfer body, a formed image has irregular color or lines, resulting in deterioration in image quality. The change in the speed of the intermediate transfer body occurs, for example, when a sheet runs into a nip between the intermediate transfer body and a roller. The force of impact on a sheet running into the nip is unsteady and transient and has broad frequency characteristics, and therefore is difficult to be suppressed by the speed control of the intermediate transfer body. As a conventional technology for coping with this, there is proposed a technology to control the pressure produced in the nip (the nip pressure).

For example, Japanese Unexamined Patent Application Publication No. 2010-151983 has disclosed a technology to keep the pressure low before a medium runs into the nip and then increase the pressure after the medium has run into the nip. However, in this technology, the pressure is applied to a fixing nip when the medium runs into the fixing nip; therefore, it is not possible to completely suppress the force of impact on a sheet running into the nip.

Furthermore, Japanese Unexamined Patent Application Publication No. 05-289569 has disclosed a technology to statically adjust the transfer pressure produced in a nip by moving the position of a secondary transfer roller according to the size or thickness of a sheet. However, in this technology, it is difficult to control the pressure according to the temperature characteristics or individual difference of the roller.

Moreover, Japanese Unexamined Patent Application Publication. No. 2014-038201 has disclosed a technology to weaken the contact pressure between a pair of registration rollers just before a sheet goes through the pair of registration rollers and suppress vibration produced when the sheet goes through the pair of registration rollers while ensuring the nip pressure required to convey the sheet.

In any of these conventional technologies, a controlled object is either the pressure (the nip pressure) or the roller position. In the case where the pressure is a controlled object, a time from when a sheet runs into a nip till when an image is transferred onto the sheet is generally about five to ten milliseconds; there is a problem that it is difficult to perform pressure control in such a short time. On the other hand, in the case where the roller position is a controlled object, rollers are an elastic body, and the elastic modulus varies with environmental changes and aged deterioration; therefore, mere is a problem that for example, even if the roller position is controlled on the basis of the amount of roller deformation, it is difficult to strictly control the nip pressure.

SUMMARY OF THE INVENTION

According to one aspect of the present invention, there is provided a pressurizing device including: first and second rollers configured to hold a sheet-like medium with an image bearer formed on at least part of a surface of the medium between the first and second rollers and send the medium in a conveying direction while applying a pressure to the medium; a driving unit configured to displace the position of at least one of the first and second rollers to make the first and second rollers come close to or separate from each other; a position control unit configured to control the driving unit, and perform feedback control of the position of at least one of the first and second rollers; a force control unit configured to control the driving unit, and perform feedback control of a force acting on between the first and second rollers; and a control-method switching unit configured to switch, after the position of the first and second rollers is switched from a separation position to a contact position by the feedback control performed by the position control unit, a feedback controlled object so that the force becomes a target value of nip pressure through the feedback control performed by the force control unit.

According to another aspect of the present invention, there is provided a control method performed by a pressurizing device, the pressurizing device including: first and second rollers configured to hold a sheet-like medium with an image bearer formed on at least part of a surface of the medium between the first and second rollers and send the medium in a conveying direction while applying a pressure to the medium; and a driving unit configured to displace the position of at least one of the first and second rollers to make the first and second rollers come close to or separate from each other, and the control method including: controlling the driving unit and performing feedback control of the position of at least one of the first and second rollers; controlling the driving unit and performing feedback control of a force acting on between the first and second rollers; and switching, after the position of the first and second rollers is switched from a separation position to a contact position through position control, a feedback controlled object so that the force becomes a target value of nip pressure through the feedback control of force control.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DETAILED DESCRIPTION OF THE PREFERRED EMBODIMENTS

Figure 1:
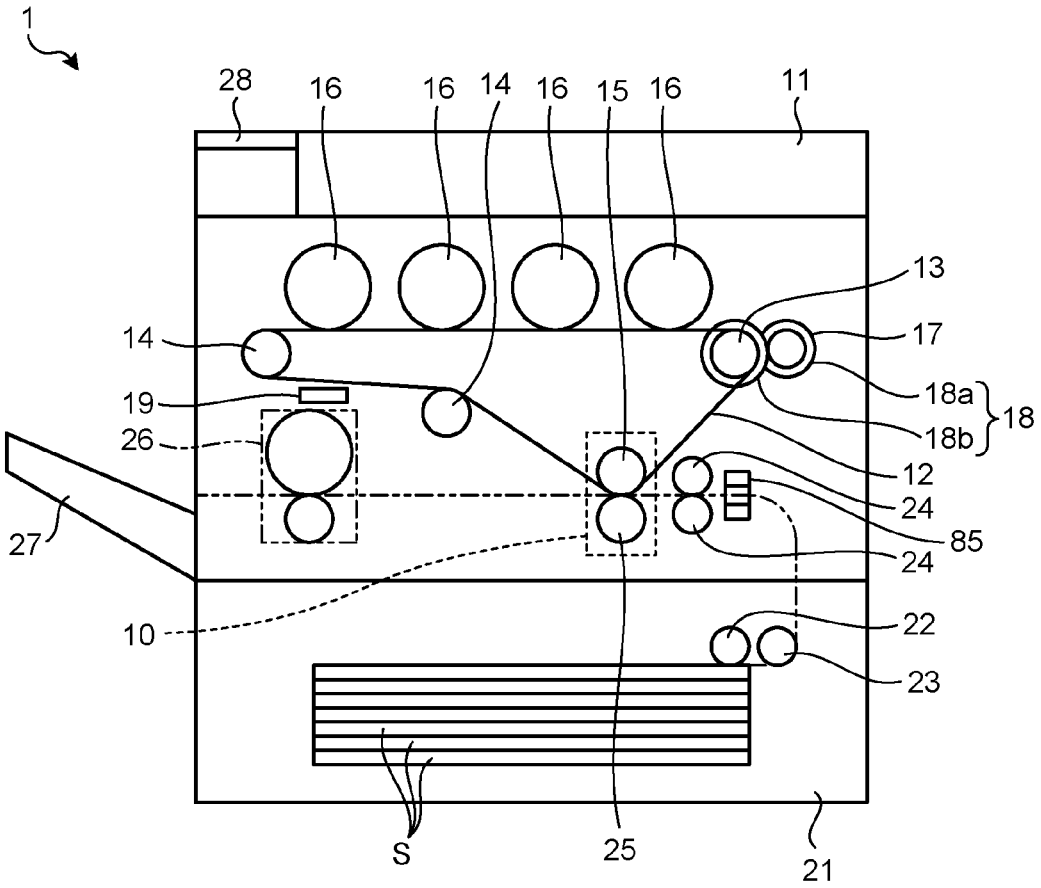
FIG. 1 is a diagram schematically showing a constructional example of an image forming apparatus according to a first embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result. An embodiment of the present invention will be described in detail below with reference to the drawings.

The present invention has an object to provide a pressurizing device, an image forming apparatus, and a control method for the pressurizing device capable of controlling the nip pressure between a pair of rollers with high accuracy and high responsiveness.

Exemplary embodiments of a pressurizing device, an image forming apparatus, and a control method for the pressurizing device according to the present invention will be described in detail below with reference to accompanying drawings. In the following description, there is provided an example where a tandem color image forming apparatus is applied as the image forming apparatus according to the present embodiments, and a transfer unit included in this image forming apparatus is applied as the pressurizing device according to the present embodiments. However, the embodiments described below are just an example, and the present invention is not limited to the embodiments.

The pressurizing device according to the present embodiments can be applied to other pressurizing mechanisms including a pair of rollers. For example, the present embodiments can be applied to the control of a pair of rollers included in, for example, a fixing unit, a photoconductor, a sheet conveyance unit, or the like. Incidentally, in the case where a configuration other than the transfer unit is applied as the pressurizing device according to the present embodiments the image forming apparatus according to the present embodiments is not limited to a tandem color image forming apparatus. In such case, the image forming apparatus according to the present embodiments can be applied to a monochrome image forming apparatus or an ink-jet image forming apparatus. Incidentally, the image forming apparatus according to the present embodiments can be applied to any of a copier, a printer, a scanner, and a facsimile machine, or can be applied to a multifunction peripheral having ac least any two of the following functions: copy function, printer function, scanner function, and facsimile function.

First Embodiment

Constructional Example of Image Forming Apparatus

FIG. 1 is a diagram schematically showing a constructional example of an image forming apparatus according to a first embodiment. As shown in FIG. 1, the image forming apparatus 1 includes a scanner unit 11, an intermediate transfer belt 12, a drive roller 13, two driven rollers 14, a repulsion roller 15, four photoconductor units 16, a motor 17, and a deceleration mechanism 18. Furthermore, as shown in FIG. 1, the image forming apparatus 1 further includes a belt encoder sensor 19, a sheet feeding unit 21, a sheet feeding roller 22, a sheet conveyance roller 23, and a pair of registration rollers 24. Moreover, as shown in FIG. 1, the image forming apparatus 1 still further includes a secondary transfer roller 25, a fixing unit 26, a sheet ejection unit 27, and an operation input unit 28.

The repulsion roller 15 is an example of a first roller, and the secondary transfer roller 25 is an example of a second roller.

The scanner unit 11 reads an image of an original put on top of an original plate. The intermediate transfer belt 12 is composed of an endless belt, and is supported by the drive roller 13, the driven rollers 14, and the repulsion roller 15. A mechanism including the intermediate transfer belt 12, the drive roller 13, the driven rollers 14, and the repulsion roller 15 is referred to as a belt mechanism.

The four photoconductor units 16 are for yellow (Y), cyan (C), magenta (M), and black (K) colors, respectively. The photoconductor units 16 each include various components such as a drum-like photoconductor drum as a latent image bearer and a photoconductor cleaning roller.

The drive roller 13 drives the intermediate transfer belt 12 to rotate. The motor 17 drives the drive roller 13 through the deceleration mechanism 18. The deceleration mechanism 18 includes gears 18*a* and 18*b* that differ in number of gear teeth. The gears 18*a* and 18*b* mesh with each other, and reduce the rotation speed of the motor 17 and transmit the driving force of the motor 17 to the drive roller 13.

The belt encoder sensor 19 is an encoder for measuring the surface speed of the intermediate transfer belt 12. The belt encoder sensor 19 detects a scale formed on the intermediate transfer belt 12 and generates a pulse output.

The photoconductor units 16 form a full-color image by superimposing Y, C, M, and K toner images on top of another on the intermediate transfer belt 12 that is a medium on which an image is formed. Incidentally, the configuration of the photoconductor units 16 is not limited to this; for example, the image forming apparatus 1 can be provided with three photoconductor units 16 for Y, C, and M colors.

The sheet feeding unit 21 contains a stack of transfer sheets S. The transfer sheets S are an example of a print medium. The sheet feeding roller 22 feeds a transfer sheet S from the sheet feeding unit 21 to a conveyance path indicated by an alternate long and two short dashes line in FIG. 1. The sheet conveyance roller 23 is placed on the conveyance path, and conveys the transfer sheet S fed by the sheet feeding roller 22 to the pair of registration rollers 24. The pair of registration rollers 24 performs correction of the skew of the transfer sheet 5, conveyance of the transfer sheet S, etc.

The secondary transfer roller 25 is placed to be opposed to the repulsion roller 15. A secondary transfer nip area is formed between the repulsion roller 15 (the intermediate transfer belt 12) and the secondary transfer roller 25. Incidentally, for the sake of simplicity, a gap between the repulsion roller 15 and the secondary transfer roller 25 is treated as the secondary transfer nip area (hereinafter, referred to simply as the nip). The secondary transfer roller 25 transfers a YMCK toner image formed on the intermediate transfer belt 12 by the photoconductor units 16 onto a transfer sheet S passing through the nip.

The secondary transfer roller 25 is freely rotatable, and rotates by coming in contact with, for example, the intermediate transfer belt 12 or a transfer sheet S conveyed on the intermediate transfer belt 12. Incidentally, the image forming apparatus 1 can include a mechanism that drives the secondary transfer roller 25 to rotate.

The fixing unit 26 fixes a toner image transferred onto a transfer sheet S by the secondary transfer roller 25 on the transfer sheet S by applying heat and pressure. The transfer sheet S on which the toner image has been transferred and fixed is elected to the sheet ejection unit 27.

The operation input unit 28 is, for example, an operation panel installed on the top surface of the image forming apparatus 1, and is an input/output device with a user interface. Incidentally, the image forming apparatus 1 can received a user's operation input from a PC or tablet terminal connected to the image forming apparatus 1 as the operation input unit 28.

In the above configuration, if the surface speed of the intermediate transfer belt 12 changes, misregistration of Y, C, N, and K toner images to be superimposed on top of another or expansion and contraction of the toner images may occur. This may cause a formed image a defect such as color shift or color shading called banding. Such a change in the surface speed of the intermediate transfer belt 12 occurs when a medium such as a transfer sheet S runs into, for example, the nip between the repulsion roller 15 (the intermediate transfer belt 12) and the secondary transfer roller 25.

Nip Distance and Nip Pressure

The distance of the nip between the repulsion roller 15 and the secondary transfer roller 25 and nip pressure produced in the nip are explained with FIGS. 2 to 5.

Figure 2:
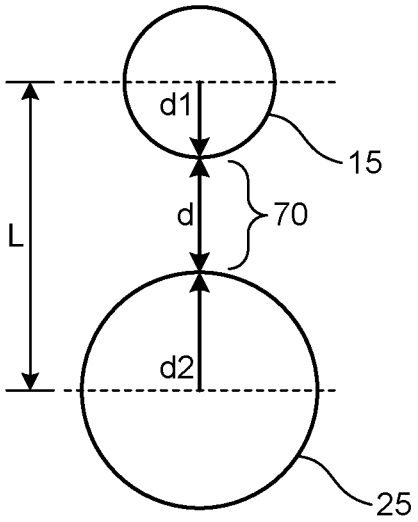
FIG. 2 is a schematic diagram showing a state in which a repulsion roller and a secondary transfer roller are separated.

FIG. 2 is a schematic diagram showing a state in which the repulsion roller 15 and the secondary transfer roller 25 are separated. A distance d (length) of a nip 70 is a length obtained by subtracting a radius d1 of the repulsion roller 15 and a radius d2 of the secondary transfer roller 25 from a shaft-to-shaft distance L between the repulsion roller 15 and the secondary transfer roller 25. That is, it is calculated by the following equation: $d=L-d1-d2$. As shown in FIG. 2, when the repulsion roller 15 and the secondary transfer roller 25 are separated, $d>0$.

Figure 3:
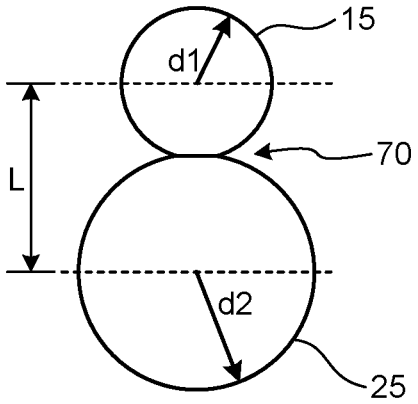
FIG. 3 is a schematic diagram showing a state in which the repulsion roller and the secondary transfer roller are in contact with each other.

FIG. 3 is a schematic diagram showing a state in which the repulsion roller 15 and the secondary transfer roller 25 are in contact with each other. When the repulsion roller 15 and the secondary transfer roller 25 are in contact with each other, $d\leq 0$. To apply nip pressure to the nip between the repulsion roller 15 and the secondary transfer roller 25, an external force is applied to at least either the shaft of the repulsion roller 15 or the shaft of the secondary transfer roller 25. Then, in the state where the repulsion roller 15 and the secondary transfer roller 25 are in contact with each other, the shaft of either roller needs to be further pressed against the other roller.

Figure 4:
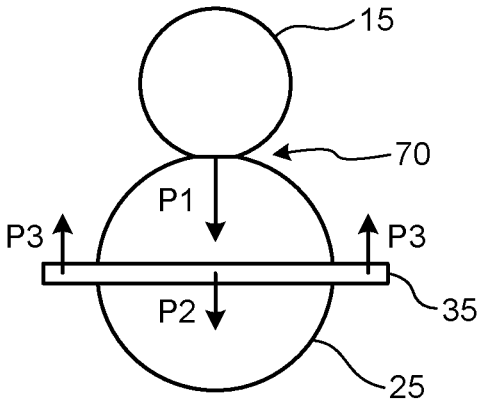
FIG. 4 is a schematic diagram showing a force acting on a nip.

FIG. 4 is a schematic diagram showing a force acting on the nip 70. The pressing of the roller shaft produces a pressure distribution in the nip 70. A sum P1 of this pressure distribution is what is called nip pressure. The nip pressure P1 can be expressed by $P1=P3-P2$ where P2 denotes the weight of the secondary transfer roller 25, and P3 denotes the sum of external force applied to a supporting part 35 to support the shaft of the secondary transfer roller 25. That is, with increasing the external force P3, the nip pressure P1 increases.

Figure 5:
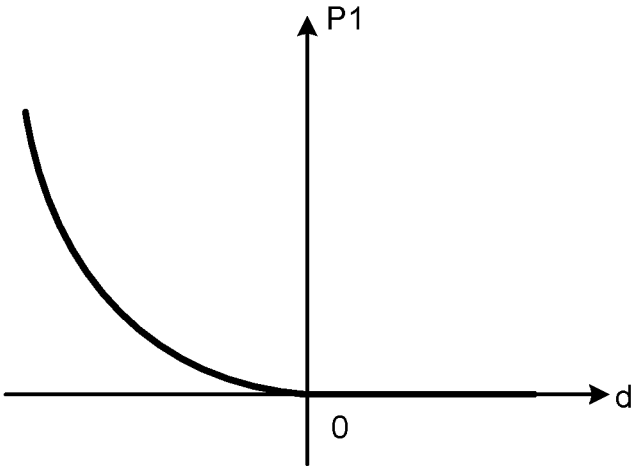
FIG. 5 is a graph schematically showing a relationship between the distance of the nip and nip pressure.

FIG. 5 is a Graph schematically showing a relationship between the distance d of the nip and the nip pressure P1. If the external force P3 is further increased after the repulsion roller 15 and the secondary transfer roller 25 have come in contact with each other, the respective roller shafts are further pressed against each other, and the distance d of the nip between the rollers takes a negative value and its absolute value increases. That is, the surface of at least either the repulsion roller 15 or the secondary transfer roller 25 is elastically deformed, and the shaft-to-shaft distance further decreases. That is, as shown in FIG. 5, if the distance d of the nip is $d\geq 0$, the nip pressure P1 is $P1=0$; if $d<0$, $P1>0$, which produces nip pressure.

Position Control and Force Control

The distance d of the nip can be relatively easily measured with a position sensor or the like that detects the position of the repulsion roller 15 or the secondary transfer roller 25. Therefore, a pressurizing device 10 just calculates the distance d of the nip by monitoring the output of the position sensor and feeds back the calculated distance d, and controls the position of, for example, the secondary transfer roller 25. In this way, by measuring the position of the secondary transfer roller 25 and performing the feedback control (position control) the output of the position sensor becomes stabilized quickly. That time taken to get the deviation between the actual position and a target value close to zero is short.

However, as also shown in FIG. 5, the relationship between the distance d of the nip and the nip pressure P1 is not the one expressed by a simple equation. Furthermore, the relationship between the distance d of the nip and the nip pressure P1 varies with temperature and other conditions, so it is difficult to define the relational expression. That is, this control method for feedback controlling the distanced of the nip is suitable for coarsely moving a mechanism for pressing the repulsion roller 15 and the secondary transfer roller 25 against each other; however, it is not suitable for finely adjusting the nip Pressure P1 by slightly moving the pressing mechanism.

Here, the nip pressure P1 is expressed by the relational expression of $P1=P3-P2$ as described above; therefore, it can be said that the nip pressure P1 can be directly controlled by application of an appropriate external force P3. That is, the nip pressure P1 can be adjusted by monitoring the output of an actuator that controls the external force P3 and controlling (force control) of the nip pressure P1 through feedback of the output.

However, the feedback control of external force P3 does not cover the monitoring of behaviors of the supporting part 35 and the nip 70 located ahead of the actuator. Therefore, it is difficult to keep the nip pressure P1 within a target range quickly in an intended time while causing the position of the secondary transfer roller 25 to converge on a target position. That is, this control method (force control) for feedback controlling the external force P3 is suitable for slightly moving the mechanism for pressing the repulsion roller 15 and the secondary transfer roller 25 against each other; however, it is not suitable for coarsely moving the pressing mechanism to switch between the contact and separation of the repulsion roller 15 and the secondary transfer roller 25.

In summary, feedback control of the distance d of the nip (position control) is suitable for control in coarse movement, and feedback control of the external force P3 (force control) is suitable for control in slight movement. Accordingly, in the present embodiment, taking the advantages of these two types of feedback control in the contact state by switching between the two, the speedy contact control is performed and the pressure adjusting function is improved.

Constructional Example of Pressurizing Device

Figure 6:
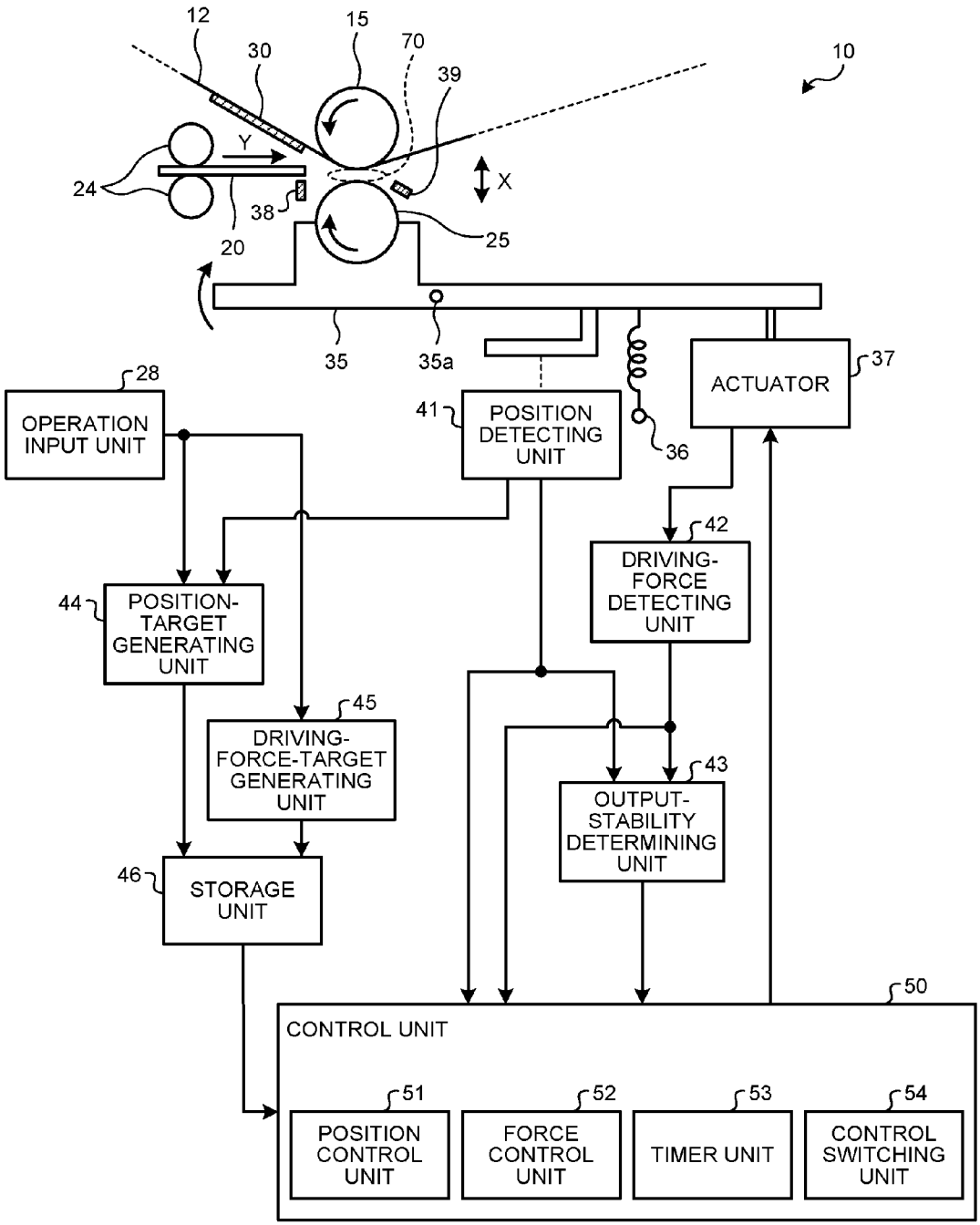
FIG. 6 is a diagram schematically showing a constructional example of a pressurizing device.

FIG. 6 is a diagram schematically showing a constructional example of the pressurizing device 10. As also shown in FIG. 1, the pressurizing device 10 includes the repulsion roller 15, the secondary transfer roller 25, the pair of registration rollers 24, and the intermediate transfer belt 12. Furthermore, as shown in FIG. 6, the pressurizing device 10 includes the supporting part 35, rotating shaft 35*a*, an elastic body 36, an actuator 37, an entry sensor 38, and an escape sensor 39.

Moreover, the pressurizing device 10 includes a position detecting unit 41, a driving-force detecting unit 42, an output-stability determining unit 43, a position-target generating unit 44, a driving-force-target generating unit 45, a storage unit 46, and a control unit 50. The control unit 50 includes a position control unit 51, a force control unit 52, a timer unit 53, and a control switching unit 54. The position-target generating unit 44 and the driving-force-target generating unit 45 are connected to the operation input unit 28 of the image forming apparatus 1 (see FIG. 1).

The repulsion roller 15 and the secondary transfer roller 25 are both a cylindrical roller, and are arranged so that the central axes of the rollers are parallel to each other. The repulsion roller 15 and the secondary transfer roller 25 are installed so that they can come close to and separate from each other in a contact/separation direction X. When the repulsion roller 15 and the secondary transfer roller 25 come close, the side surfaces of the rollers are in contact with each other, and nip pressure according the shaft-to-shaft distance between the repulsion roller 15 and the secondary transfer roller 25 is produced in the nip 70. When the repulsion roller 15 and the secondary transfer roller 25 are separated, a gap is formed between the side surfaces of the rollers, and the nip pressure becomes zero.

As indicated by arrows in FIG. 6, the repulsion roller 15 and the secondary transfer roller 25 rotate in directions opposite to each other. The pair of registration rollers 24 conveys a sheet-like medium 20 toward the nip 70. The pair of registration rollers 24 is installed so that the contact position of the registration rollers 24 is at the same level as the contact position of the repulsion roller 15 and the secondary transfer roller 25, and the medium 20 conveyed by the pair of registration rollers 24 enters the nip 70 at right angle with the nip 70. When the medium 20 has entered the nip 70, the repulsion roller 15 and the secondary transfer roller 25 hold the medium 20 between them and send the medium 20 in a conveying direction Y while applying nip pressure (transfer nip pressure).

Incidentally, here, an example using the pair of registration rollers 24 is provided as an example of a conveying means that conveys the medium 20; however, the conveying means is not limited to this example. As the conveying means, an electrostatically-charged conveyance belt can be used. In this case, an area between the intermediate transfer belt 12 and the conveyance belt is the secondary transfer nip area.

On the surface of the intermediate transfer belt 12 on the side of the secondary transfer roller 25, a superimposed toner image is formed by the photoconductor units 16 (see FIG. 1). That is, a thin-layered image bearer 30 is attached to the surface of the intermediate transfer belt 12. In accordance with the rotation of the intermediate transfer belt 12, the image bearer 30 on the intermediate transfer belt 12 is also carried in the nip 70. When the image bearer 30 has been carried in the nip 70, the image bearer 30 comes in contact with the surface of the medium 20 passing through the nip 70. Then, under the nip pressure from the repulsion roller 15 and the secondary transfer roller 25, the image bearer 30 attached onto the intermediate transfer belt 12 is transferred to the surface of the medium 20.

The supporting part 35 movably supports the secondary transfer roller 25 so that the secondary transfer roller 25 can move in the contact/separation direction X. The secondary transfer roller 25 is rotatably attached to one end of the supporting part 35. The supporting part 35 rotates around the rotating shaft 35*a* at a given angle, thereby enabling the secondary transfer roller 25 to move in the contact/separation direction X. This makes the repulsion roller 15 and the secondary transfer roller 25 come close to and separate from each other.

The elastic body 36 is, for example, a compression spring; one end of the elastic body 36 is attached to the supporting part 35, and the other end is attached to an enclosure of the image forming apparatus 1. The elastic body 36 causes a force putting the secondary transfer roller 25 toward the repulsion roller 15 (in an upward direction in FIG. 6) to act on the supporting part 35.

The actuator 37 is attached to the end of the supporting part 35 on the opposite side of the end to which the secondary transfer roller 25 is attached. The actuator 37 (a driving unit) is, for example, a translational actuator. One end of the actuator 37 is attached to the surface of the supporting part 35 on the opposite side of the secondary transfer roller 25, and the other end is attached to the enclosure of the image forming apparatus 1. The actuator 37 causes a force toward either direction of the contact/separation direction X according to current flowing through the actuator 37 to act on the supporting part 35. Incidentally, the magnitude of acting force is proportionate to current flowing through the actuator 37.

First, the actuator 37 causes a force putting the secondary transfer roller 25 toward the repulsion roller 15 (in the upward direction in FIG. 6) to act on the supporting part 35. That is, the actuator 37 pushes the secondary transfer roller 25 toward the repulsion roller 15 or the intermediate transfer belt 12 supported by the repulsion roller 15.

Secondly, the actuator 37 causes a force pulling the secondary transfer roller 25 away from the repulsion roller 15 (in a downward direction in FIG. 6) to act on the supporting part 35. That is, the actuator 37 pulls the secondary transfer roller 25 in a direction away from the repulsion roller 15 or the intermediate transfer belt 12 supported by the repulsion roller 15.

In this way, the actuator 37 displaces the position of the secondary transfer roller 25 to make the repulsion roller 15 and the secondary transfer roller 25 come close to or separate from each other thereby controlling the distance of the nip 70. Furthermore, the actuator 37 controls the driving force (output) in the state where the repulsion roller 15 and the secondary transfer roller 25 are in contact with each other, thereby changing the nip pressure acting on between the repulsion roller 15 and the secondary transfer roller 25.

Incidentally, the configuration of the actuator 37 is not necessarily limited to the above-described configuration as long as the distance between the secondary transfer roller 25 and the repulsion roller 15 can be increased or decreased. That is, the actuator 37 can only have a configuration that causes a force to act on at least either the secondary transfer roller 25 or the repulsion roller 15 and displaces the position of at least either one of the two.

Incidentally, in the above configuration, the supporting part 35 is provided to the secondary transfer roller 25 side only, and the nip distance or the nip pressure is changed by moving the secondary transfer roller 25 side only; however, the embodiment is not limited to this. As another example, a configuration equivalent of the supporting part 35, the elastic body 36, and various control means can be provided to the repulsion roller 15 side so as to drive the repulsion roller 15 side. Or, it can be configured that a configuration equivalent of the actuator 37, the elastic body 36, and various control means is provided to both the repulsion roller 15 side and the secondary transfer roller 25 side so as to control the positions of both.

The entry sensor 38 (an entry detecting unit) and the escape sensor 39 (an escape detecting unit) are composed of, for example, an optical sensor module. The entry sensor 38 detects the entry of a medium 20 into the nip 70. That is, the entry sensor 38 detects the position of a leading end (a right-hand edge in FIG. 6) of the medium 20 in the conveying direction Y, and calculates timing at which the leading end of the medium 20 enters the nip 70 on the basis of the distance between the entry sensor 38 and the nip 70.

The escape sensor 39 detects the escape of a medium 20 from the nip. That is, the escape sensor 39 detects whether a tail end (a left-hand edge in FIG. 6) of the medium 20 in the conveying direction Y has escaped from the nip 70.

More preferably, the escape sensor 39 calculates timing at which a tail end of a sheet escapes from the nip 70 on the basis of information such as the timing to enter the nip calculated by the entry sensor 38, the size of the medium 20, and the sheet conveying speed, and expects the timing to escape from the nip. This can ease a change in the speed of the intermediate transfer belt 12 at the time when the medium 20 escapes from the nip.

The position detecting unit 41 is, for example, a sensor module using optical beams. The position detecting unit 41 detects the movement position of the supporting part 35, and detects the position of the secondary transfer roller 25 on the basis of the detected movement position of the supporting part 35. Incidentally, the position detecting unit 41 can detect the movement position of the supporting part 35 by using an encoder, a resolver, a strain gage, etc. that are implanted in the actuator 37.

The driving-force detecting unit 42 detects an output (a driving force) of the actuator 37. The driving-force detecting unit 42 is, for example, a sensor module that detects a force that the actuator 37 causes to act on the supporting part 35 on the basis of electricity consumption of the actuator 37. Incidentally, the driving-force detecting unit 42 can detect an acting force of the actuator 37 by using a strain gage or a piezoelectric element. At this time, one end of the strain gage or piezoelectric element is attached to the shaft of the repulsion roller 15, and the other end is attached to the shaft of the secondary transfer roller 25.

The output-stability determining unit 43 is composed of, for example, an A/D converter and a processor. The output-stability determining unit 43 can be composed of an analog computing circuit using an operational amplifier. The output-stability determining unit 43 determines whether an output signal (an output value) of the position detecting unit 41 becomes stabilized, and notifies the control unit 50 of the output stability when it has become stabilized. For example, when a difference between an output at a certain point of time and the latest output of the position detecting unit 41 is equal to or less than a predetermined threshold, the output-stability determining unit 43 determines that the output of the position detecting unit 41 becomes stabilized.

Incidentally, the output-stability determining unit 43 can determine the output stability by another method. For example, when a difference between the output (position) of the position detecting unit 41 and a position target value based on a position target profile is equal to or less than a predetermined threshold, the output-stability determining unit 43 can determine that the output of the position detecting unit 41 becomes stabilized. Furthermore, when determining the output stability, the output-stability determining unit 43 can use the above criteria for determination and perform the stability determination on the basis of the logical conjunction or logical addition of the criteria for determination.

The position-target generating unit 44 is composed of, for example, a processor or the like. The position-target generating unit 44 generates a position target profile on the basis of an output of the position detecting unit 41 and an input from the operation input unit 28, and stores the generated position target profile in the storage unit 46. Incidentally, the position-target generating unit 44 generates a contact-position target profile and separation-position target profile as the position target profile.

The position target profile shows time transition of the target position of the secondary transfer roller 25 when the secondary transfer roller 25 is brought close to or separated from the repulsion roller 15. The contact-position target profile is a profile used in a process of bringing the secondary transfer roller 25 close to the repulsion roller 15, and the separation-position target profile is a profile used in a process of separating the secondary transfer roller 25 from the repulsion roller 15.

More specifically, the position-target generating unit 44 generates the contact-position target profile on the basis of position information of the secondary transfer roller 25 acquired by the position detecting unit 41 at the time of startup of the image forming apparatus 1 and information on a medium 20 input from the operation input unit 28. As the information on a medium 20, for example, characteristics such as the thickness, type, and surface elasticity of the medium 20 are used.

On the basis of these pieces of information, the position-target generating unit 44 calculates the position of the secondary transfer roller 25 in contact with the surface of the medium 20, and determines the time transition of the position of the secondary transfer roller 25 in contact movement of the secondary transfer roller 25 and set the determined time transition of the position of the secondary transfer roller 25 as a contact-position target profile.

Furthermore, the position-target generating unit 44 sets the time transition of the position of the secondary transfer roller 25 when the actuator 37 separates the secondary transfer roller 25 from the repulsion roller 15 as a separation-position target profile. At this time, the position-target generating unit 44 determines the time transition of the position of the secondary transfer roller 25 on the basis of position information of the secondary transfer roller 25 acquired by the position detecting unit 41 at the time of startup of the image forming apparatus 1.

The driving-force-target generating unit 45 is composed of, for example, a processor or the like. The driving-force-target generating unit 45 generates a force target profile on the basis of an input from the operation input unit 28, and stores the generated force target profile in the storage unit 46.

The force target profile shows time transition of a target value of the force acting on between the secondary transfer roller 25 and the repulsion roller 15 when the actuator 37 brings the secondary transfer roller 25 into contact with the repulsion roller 15, i.e., the driving force of the actuator 37.

The driving-force-target generating unit 45 determines the time transition of the driving force of the actuator 37 when bringing the secondary transfer roller 25 into contact with the repulsion roller 15 according to characteristics such as the thickness, type, and surface elasticity of a medium 20 input from the operation input unit 28, and sets the determined time transition of the driving force of the actuator 37 as a force target profile.

The storage unit 46 is, for example, main storage or auxiliary storage, and stores therein the position target profile and the force target profile. Furthermore, the storage unit 46 stores therein the contact-position target profile and the separation-position target profile as the position target profile.

The control unit 50 is composed for example, a Processor and a driver interface for controlling the operation of the actuator 37. As shown in FIG. 6, the control unit 50 mainly includes the position control unit 51, the force control unit 52, the timer unit 53, and the control switching unit 54.

Schematically, the position control unit 51 performs feedback control of the position of the secondary transfer roller 25 on the basis of the position target profile and a result of the detection by the position detecting unit 41. Accordingly, the position control unit 51 controls the contact operation of the secondary transfer roller 25 and the repulsion roller 15 (in FIG. 7, transition control of switching from the separation position to the contact position, an operation at Step S3). Furthermore, the position control unit 51 controls the separation operation (in FIG. 7, separation control of switching from the contact position to the separation position, i.e., an operation at Step S2).

On the other hand, the force control unit 52 performs feedback control of acting force of the secondary transfer roller 25 on the repulsion roller 15 (the driving force of the actuator 37) on the basis of the force target profile and a result of the detection by the driving-force detecting unit 42. Accordingly, the force control unit 52 controls the contact operation of the secondary transfer roller 25 and the repulsion roller 15 (in FIG. 7, a contact operation at Step S4).

More specifically, when the entry sensor 38 has detected the entry of a medium 20 into the nip 70, the position control unit 51 reads the contact-position target profile from the storage unit 46. The position control unit 51 calculates a difference between a target position of the secondary transfer roller 25 at each point of time obtained from the contact-position target profile and the position of the secondary transfer roller 25 detected by the position detect ng unit 41. Then, the position control unit 51 performs feedback control of the actuator 37 so that the calculated difference becomes zero.

Furthermore, when the escape sensor 39 has detected the escape of the medium 20 from the nip 70, the position control unit 51 reads the separation-position target profile from the storage unit 46. The position control unit 51 performs feedback control of the actuator 37 on the basis of the separation-position target profile and the position of the secondary transfer roller 25 detected by the position detecting unit 41, and moves the secondary transfer roller 25 and the repulsion roller 15 to the separation position.

When the position control unit 51 has moved the secondary transfer roller 25 to the contact position according to the contact-position target profile and the output-stability determining unit 43 has determined that the output becomes stabilized at the contact position, the force control unit 52 reads the force target profile from the storage unit 46. The force control unit 52 calculates a difference between a target value of driving force at each point of time obtained from the force target profile and a value of driving force detected by the driving-force detecting unit 42. Then, the force control unit 52 performs feedback control of the actuator 37 so that the calculated difference becomes zero.

The timer unit 53 for example, a clock module including a quartz crystal unit and a divider circuit. The timer unit 53 outputs a clock signal (a clock pulse) to the position control unit 51, the force control unit 52, and the control switching unit 54. The position control unit 51, the force control unit 52, and the control switching unit 54 start performing a process in synchronization with the clock signal from the timer unit 53.

The processing speed of the control unit 50 increases with increasing clock frequency; however, adversely, the processing capability of the processor of the control unit 50 needs to be increased, resulting in an increase in cost. Therefore, a necessary clock frequency for a series of operations of the pressurizing device 10 is just to be selected. As an example, the clock pulse period is preferably 0.5 milliseconds in accordance with the contact position control of the repulsion roller 15 and the secondary transfer roller 25.

The control switching unit 54 is composed of, for example, a processor. The control switching unit 54 can be composed of a multiplexer. The control switching unit 54 switches between the position control by the position control unit 51 and the force control by the force control unit 52 according to outputs of the position control unit 51 and the force control unit 52, an output signal from the output-stability determining unit 43, outputs from the entry sensor 38 and the escape sensor 39, etc. Schematically, the control switching unit 54 moves the secondary transfer roller 25 and the repulsion roller 15 from the separation position to the contact position through the feedback control by the position control unit 51. After that, the control switching unit 54 switches a control signal to be input to the actuator 37 from the output of the position control unit 51 to the output of the force control unit 52. Then, the control switching unit 54 switches a feedback controlled object so that a force acting on between the secondary transfer roller 25 and the repulsion roller 15 becomes a target value of nip pressure through the feedback control by the force control unit 52.

Operation Example

Subsequently, respective procedure example of control processes performed by the pressurizing device 10 are explained with flowcharts.

Figure 7:
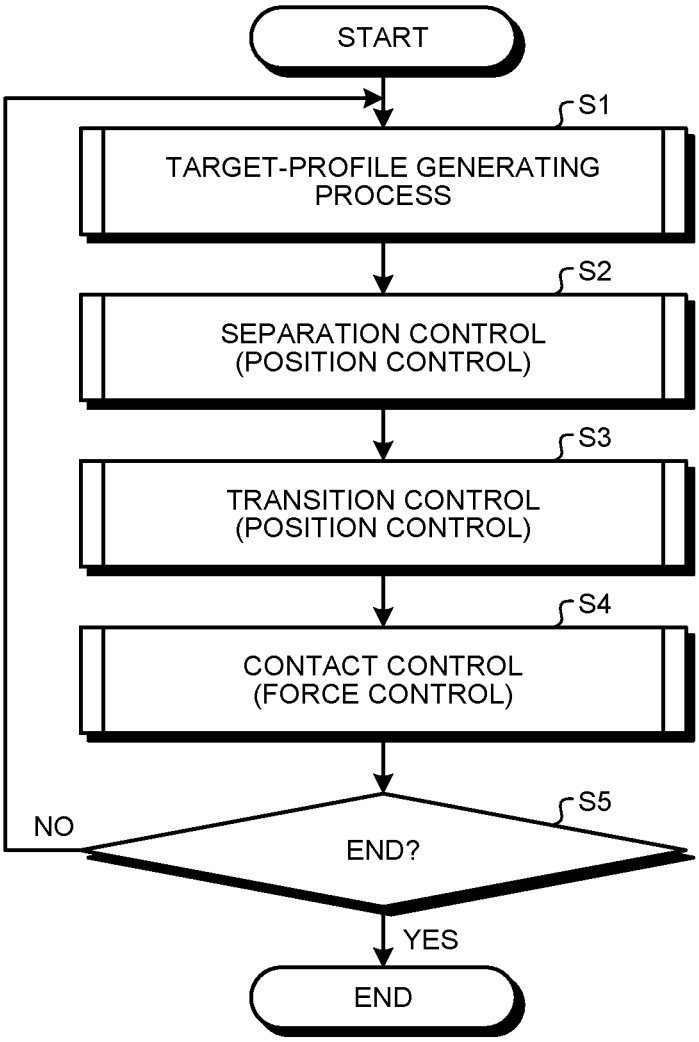
FIG. 7 is a flowchart showing a schematic procedure of a series of control processes performed by the pressurizing device.

FIG. 7 is a flowchart showing a schematic procedure of series of control processes performed by the pressurizing device 10. When a print job has been input from the operation input unit 28, the pressurizing device 10 performs a target profile generating process according to content of the input print job (Step S1). The procedure of the target-profile generating process will be explained later with FIG. 8. When the target-profile generating process has been finished, the pressurizing device 10 performs separation control (Step S2). The procedure of the separation control will be explained later with FIG. 9. When the separation control has been finished, the pressurizing device 10 moves on to transition control (Step S3). The procedure of the transition control will be explained later with FIG. 10. After the transition control, the pressurizing device 10 performs contact control (Step 34). When the image forming apparatus 1 has been powered off and the print process has been finished (YES at Step S5), the pressurizing device 10 ends the series of control processes. If the image forming apparatus 1 has not been powered off (NO at Step S5), returning to Step S1, the processes from Step S1 onward are performed according to the next print job input from the operation input unit 28.

Incidentally, the target-profile generating process (Step S1) can be performed not upon receipt of a print job but only at the time of startup of the image forming apparatus 1.

Figure 8:
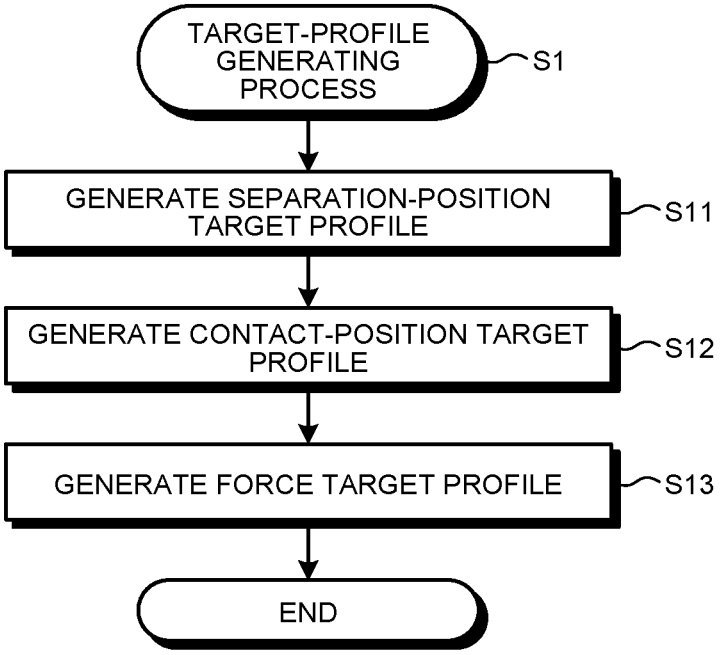
FIG. 8 is a flowchart showing a procedure of a target-profile generating process performed by the pressurizing device.

FIG. 8 is a flowchart showing a procedure of the target-profile generating process performed by the pressurizing device 10.

First, the position-target generating unit 44 generates a separation-position target profile on the basis of the position of the secondary transfer roller 25 at the time of startup, and stores the generated separation-position target profile in the storage unit 46 (Step 1). Then, the position-target generating unit 44 generates contact-position target profile, and stores the generated contact-position target profile in the storage unit 46 (Step 312). For example the position-target generating unit 44 reads information on characteristics of sheets such as the types of sheets and the thickness of each sheet type from the storage unit 46, and generates a contact-position target profile according to each sheet type.

Then, the driving-force-target generating unit 45 generates a force target profile, and stores the generated force target profile in the storage unit 46 (Step S13). For example, the driving-force-target generating unit 45 reads information on characteristics such as the thickness and surface elasticity of each type of sheets from the storage unit 46, and generates a force target profile according to each sheet type.

Figure 9:
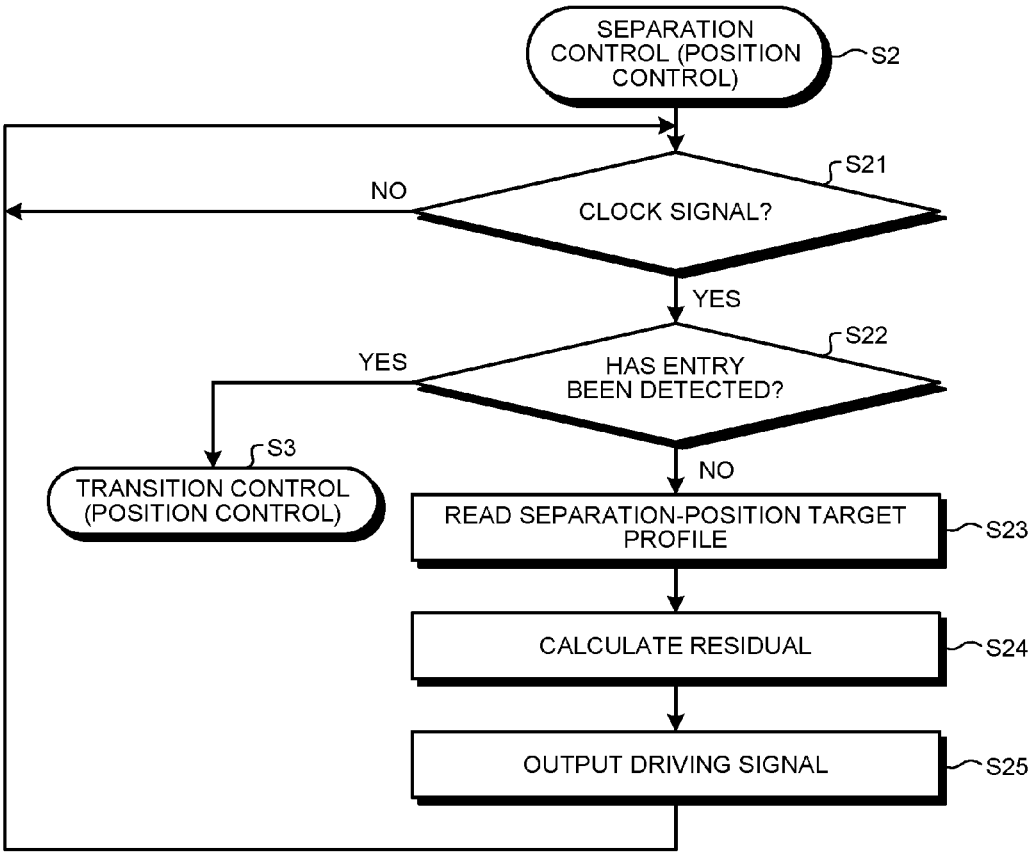
FIG. 9 is a flowchart showing a procedure of separation control performed by the pressurizing device.

FIG. 9 is a flowchart showing a procedure of the separation control performed by the pressurizing device 10. When a clock signal, which is a trigger for the start of an arithmetic operation, has been input from the timer unit 53 (YES at Step S21), the process moves on to Step S22. If no clock signal has been input (NO at Step S21), the process holds at Step S21.

Figure 10:
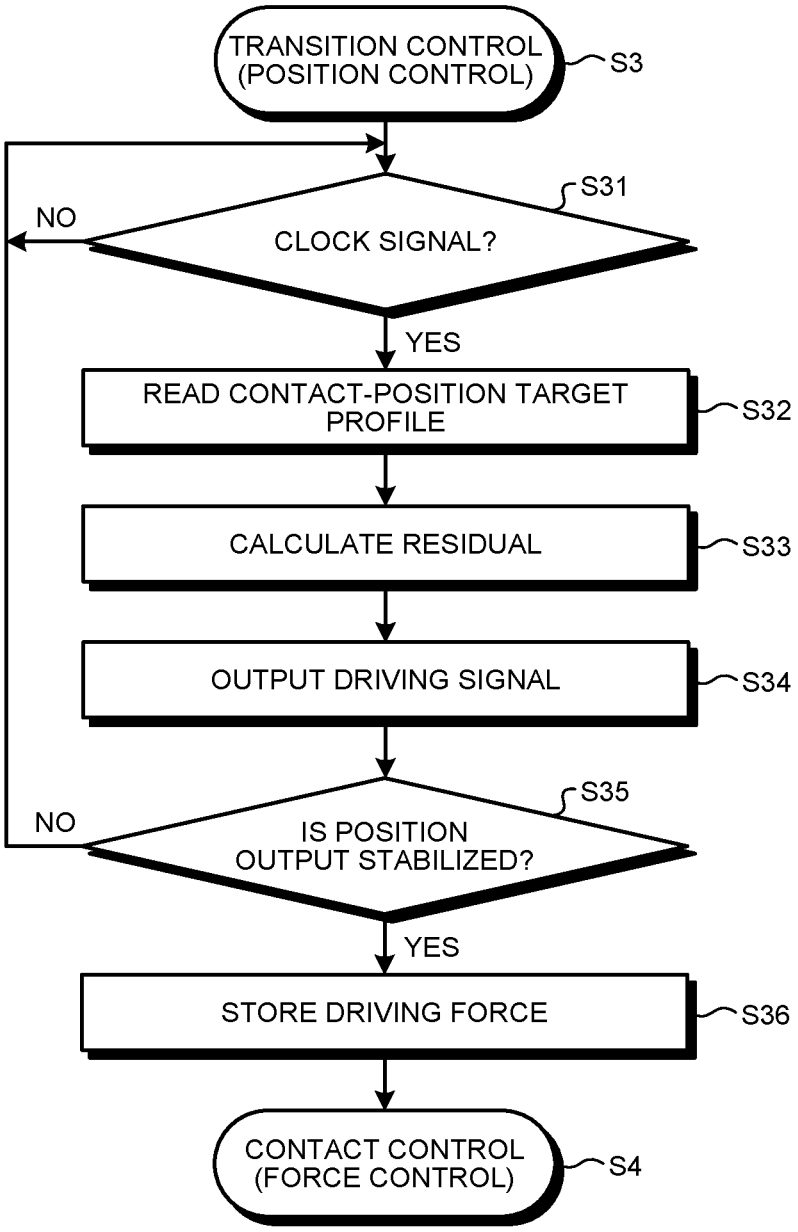
FIG. 10 is a flowchart showing a procedure of transition control performed by the pressurizing device.

When the entry sensor 38 has detected the entry of a medium 20 into the nip (YES at Step S22), the control switching unit 54 switches the process to the transition control (Step S3 in FIG. 7, see FIG. 10).

If the entry sensor 38 has not detected the entry of a medium 20 into the nip (NO at Step S22), the control switching unit 54 does not switch the control, and the separation control by the position control unit 51 continued. The position control unit 51 reads the separation-position target profile from the storage unit 46 (Step S23).

Incidentally, at Step S22, whether the medium 20 has entered the nip is determined on the basis or an output of the entry sensor 38; however, the timing of transition to the transition control (Step S3) is not limited to the point of time when the medium 20 has entered the nip. As another example, the transition to the transition control can be made by adding a predetermined delay time since the time when an output signal of the entry sensor 38 has been received. The delay time can be determined on the basis of, for example, a delay time between the entry of the medium 20 into the nip and the start of application of nip pressure to the medium 20.

The position control unit 51 calculates a residual between a target position of the secondary transfer roller 25 at each point of time obtained from the contact-position target profile and the position of the secondary transfer roller 25 detected by the position detecting unit 41 (Step S24). Then, the position control unit 51 generates a driving signal according to the residual, and outputs the driving to the actuator 37 (Step S25). For example, the position control unit 51 determines the moving distance and moving direction of the secondary transfer roller 25 so that the residual is eliminated, and generates a driving signal including these. After that, returning to Step S21, the position control unit 51 repeatedly performs the procedure from Step S22 onward with a period of a clock signal.

FIG. 10 is a flowchart showing a procedure of the transition control performed by the pressurizing device 10. When a clock signal, which is a trigger for the start of an arithmetic operation, has been input from the timer unit 53 (YES at Step S31), the process moves on to Step S32. If no clock signal has been input (NO at Step S31), the process holds at Step S31.

When a clock signal has been input, the position control unit 51 reads the contact-position target profile from the storage unit 46 (Step S32). The position control unit 51 calculates a residual between a target position of the secondary transfer roller 25 at each point of time obtained from the contact-position target profile and the position of the secondary transfer roller 25 detected by the position detecting unit 41 (Step S33). Then, the position control unit 51 generates a driving signal according to the residual, and outputs the driving signal to the actuator 37 (Step S34). For example, the position control unit 51 determines the moving distance and moving direction of the secondary transfer roller 25 so that the residual is eliminated, and generates a driving signal including these.

Then, the output-stability determining unit 43 determines whether the position of the secondary transfer roller 25 detected by the position detecting unit 41 position output) becomes stabilized at the target position (Step S35). If the position output is not stabilized at the target position (NO at Step S35), returning to Step S31, the processes from Step S32 onward are repeated with a period of a clock signal. When the output-stability determining unit 43 has determined that the position output becomes stabilized at the target position (YES at Step S35), the position control unit 51 stores the driving force of the actuator 37 when the output has become stabilized in the storage unit 46 (Step S36). Information of the stored driving force is used in a process to be described later with FIG. 13. After that, the control switching unit 54 moves the process to the contact control (Step S4 in FIG. 7, see FIG. 11).

Figure 11:
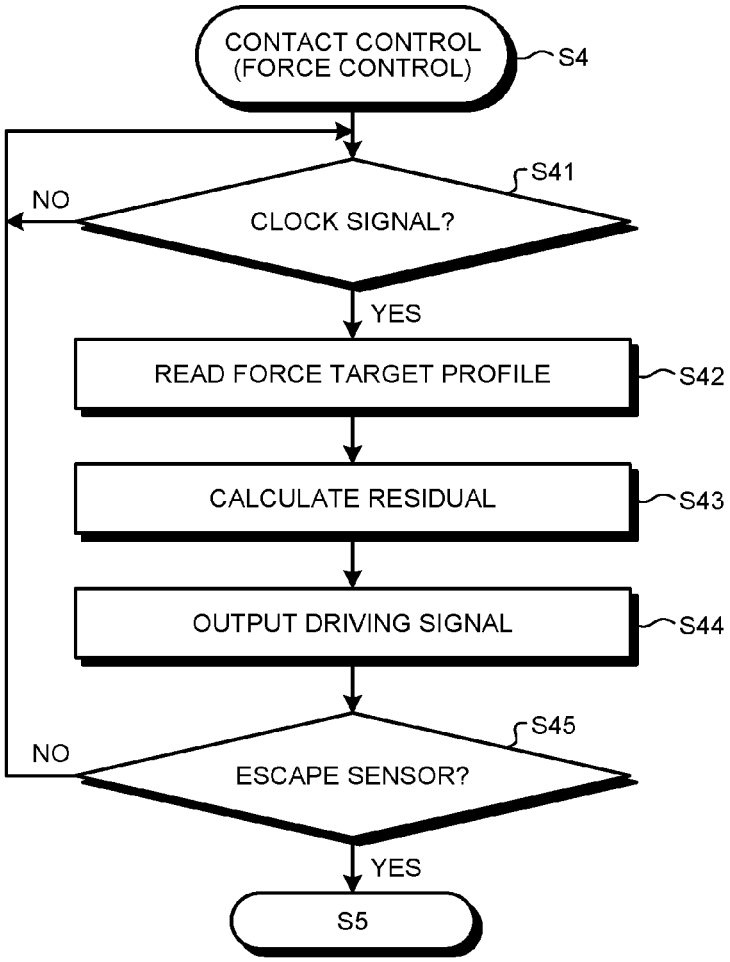
FIG. 11 is a flowchart showing a procedure of contact control performed by the pressurizing device.

FIG. 11 is a flowchart showing a procedure of the contact control performed by the pressurizing device 10. When a clock signal, which is a trigger for the start of an arithmetic operation, has been input from the timer unit 53 (YES at Step S41), the process moves on to Step S42. If no clock signal has been input (NO at Step S41), the process holds at Step S41.

When a clock signal has been input, the force control unit 52 reads the force target profile from the storage unit 46 (Step 342). The force control unit 52 calculates a residual between a driving force of the actuator 37 at each point of time obtained from the force target profile and a driving force detected by the driving-force detecting unit 42 (Step S43). Then, the force control unit 52 generates a driving signal according to the residual, and outputs the driving signal to the actuator 37 (Step S44). For example, the force control unit 52 determines the magnitude and direction of the driving force so that the residual is eliminated, and generates a driving signal including these.

Then, when the escape sensor 39 has detected the escape of the medium 20 from the nip (YES at Step S45), the control unit 50 moves on to the process at Step S5 in FIG. 7. If the escape sensor 39 has not detected the escape of the medium 20 from the nip (NO at Step S45), returning to Step 341, the processes from Step 341 onward are continued.

Incidentally, when the tail end of the medium 20 (in the conveying direction) escapes from the nip, the nip pressure is preferably small, and the transition from the contact state to the separation state is preferably made quickly. That is, the transition timing from YES at Step S45 to Step S5 is preferably made quickly. Therefore, unlike the case of the transition from YES at Step S22 in FIG. 9 to Step S3, addition of a delay time to the sensor detection timing is not performed here. The transition to Step S5 is preferably made in immediate response to the detection timing of the escape sensor 39.

Variation 1

As Variation 1 of the first embodiment, there is provided an example in which the above-described function of the force control unit 52 is achieved by using a configuration of an integrator 521.

Figure 12:
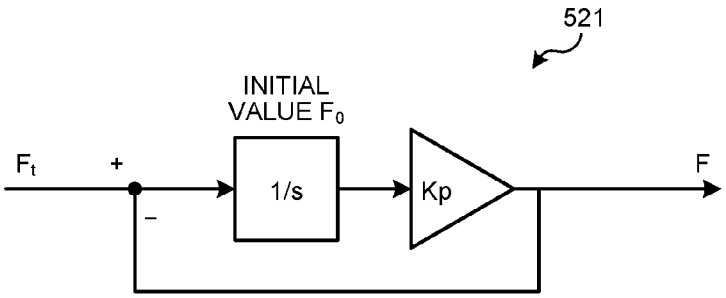
FIG. 12 is a control diagram showing a configuration example of a force control unit according to Variation 1.

FIG. 12 is a control diagram shoving a configuration example of the force control unit 52 according to Variation 1. As shown in FIG. 12, the force control unit 52 includes the integrator 521. Incidentally, the function of the integrator 521 can be composed of an analog circuit (an integrating circuit), or can be composed of software. As shown in FIG. 12, a force target profile $F_t$ input to the integrator 521 is a constant unrelated to time, and, for the sake of simplicity, a control system of the integrator 521 is defined by a continuous system. At the time of switching from the position control (Step S3 in FIG. 7) to the force control (Step S4 in FIG. 7), the force control unit 52 acquires (detects) an output of the actuator 37 in the position control. Then, the force control unit 52 sets (updates) the acquired output of the actuator 37 in the position control as an initial value $F_0$ of the integrator 521 (Step S402 in FIG. When the initial value of the integrator 521 is denoted by $F_0$ in this way, an output F of the integrator 521, i.e., an output F of the force control unit 52 can be expressed by the following Equation (1). Incidentally, 1/Kp is a time constant of the integrator 521.

$$F=F_t-e^{-Kpt}(F_t-F_0) \quad (1)$$

From Equation (1), an output of the integrator 521 is the output initial value $F_0$ of the integrator 521 if time t=0 which is immediately after the switching from the position control to the force control. That is, $F=F_0$ (t=0). Furthermore, an output F of the integrator 521 approaches asymptotically to $F=F_t$ as the time t proceeds.

The time constant1/Kp is set according to a contact time. As an example, when an A3-size sheet is conveyed at a linear speed of 300 mm/s, it takes about one second for the sheet to escape from the nip since the entry of the sheet into the nip. Assuming that the time of coarse movement due to the position control is 0.4 second, the force control is performed for about 0.6 second. Therefore, the time constant1/Kp is preferably set to be a time than this; for example, it is preferable to set the time constant1/Kp to about 0.01 to 0.05 second.

Subsequently, there is explained an example of a processing procedure of the contact control (Step S4 in FIG. 7) when the force control unit 52 includes the configuration of the integrator 521 as described above.

Figure 13:
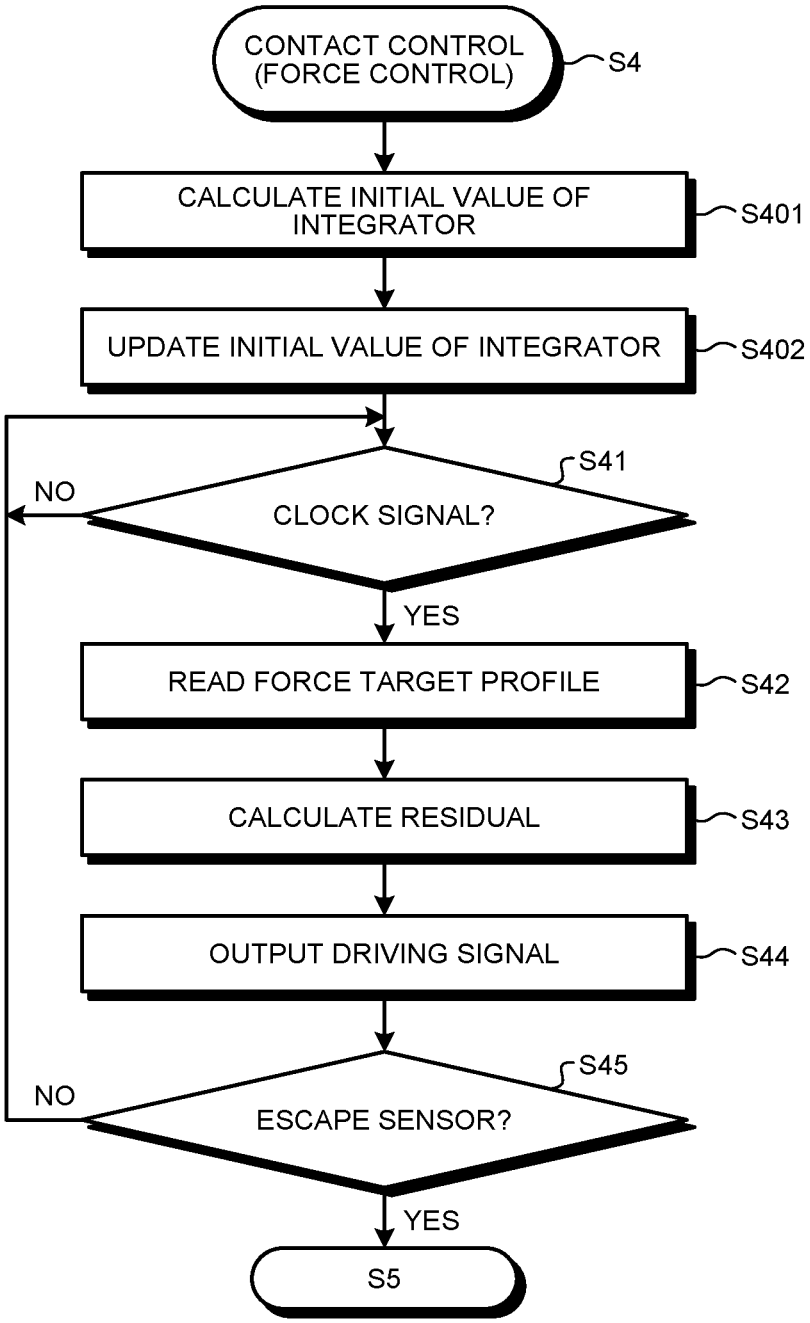
FIG. 13 is a flowchart showing an example of a processing procedure of contact control according to Variation 1.

FIG. 13 is a flowchart showing an example of a processing procedure of contact control according to Variation 1. The same step as in FIG. 11 is assigned the same reference numeral, and description of the step is omitted. Before Step S41, the force control unit 52 calculates an initial value of the integrator 521 (see FIG. 12) (Step 401). That is, the force control unit 52 calculates an initial value of the integrator 521 so that a driving force at the start of the contact control (Step S4) agrees with a driving force at the end of the transition control (Step S3, see FIG. 10), i.e., the timing indicated at Step S36 in FIG. 11. Then, the force control unit 52 sets the calculated initial value in the integrator 521.

In this way, in the example shown in FIG. 13, when the pressurizing device 10 switches from the transition control by the position control unit 51 (Step S3 in FIG. 7) to the contact control by the force control unit 52 (Step S4 in FIG. 7), the pressurizing device 10 controls so that the output of the control switching unit 54 is the same before and after the switching. That is, the pressurizing device 10 causes a driving output that the actuator 37 is ordered by the position control unit 51 in the transition control to agree with a driving output that the actuator 37 is ordered by the force control unit 52 in the previous operation period.

In such a configuration, the pressurizing device 10 can smooth an output change at the time of switching as to make the driving output of the actuator 37 when the control method is switched continuous.

Variation 2

As Variation 2 of the first embodiment, there is provided an example in which the contact-position target profile is updated when the contact control is performed.

Figure 14:
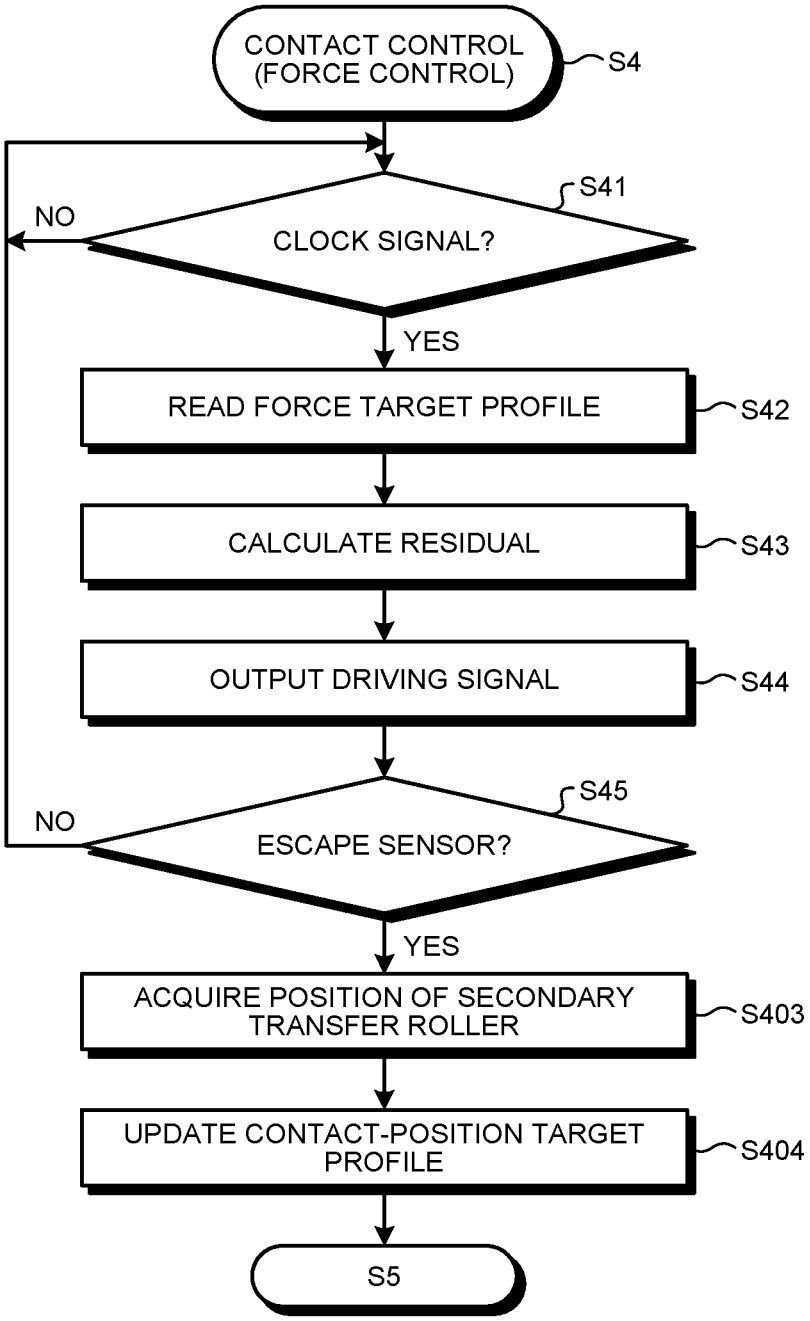
FIG. 14 is a flowchart showing an example of a processing procedure of contact control according to Variation 2.

FIG. 14 is a flowchart showing an example of a processing procedure of contact control according to Variation 2. The same step as in FIG. 11 is assigned the same reference numeral, and description of the step is omitted. In the example of the processing procedure shown in FIG. 14, if YES at Step S45, the force control unit 52 follows newly-provdded Steps S403 and S404, and then moves on to Step S5.

When the escape sensor 39 has detected the escape of the medium. 20 from the nip, the position detecting unit 41 detects (acquires) the position of the secondary transfer roller 25 (Step S403). Then, the force control unit 52 updates the contact-position target profile used in the transition control (Step S3 in FIG. 7, or see FIG. 10) with the newly-acquired position information, and stores the updated contact-position target profile in the storage unit 46 (Step S404).

Incidentally, in the above Variation 2, at Step S404, the force control unit 52 updates the contact-position target profile; alternatively, the update process can be performed by the position-target generating unit 44. Furthermore, in the above, the position detecting unit 41 detects the position of the secondary transfer roller 25 when the escape sensor 39 has detected the escape of the medium 20 from the nip at Step S45; however, the position detection timing is not limited to this. The position detecting unit 41 can detect the position of the secondary transfer roller 25 at any timing before the switching from the contact control to the separation control (i.e., the end of the contact control).

In this way, in the example shown in FIG. 14, the pressurizing device 10 acquires position information of the secondary transfer roller 25 at the end of the contact control by the force control unit 52, and updates the contact-position target profile with this. In such a configuration, the pressurizing device 10 can update the contact-position target profile in accordance with the actual device state and the contact state in an indoor environment or the like. Then, the pressurizing device 10 can feed back the contact position in the contact control (Step S4 in FIG. 7) into the next transition control (Step S3). Accordingly, the pressurizing device 10 can reduce a discontinuous change of nip pressure when the control method is switched, and therefore can improve the image quality.

Variation 3

As Variation 3 of the first embodiment, there is provided a configuration in which the contact-position target profile is updated with an average value of contact position. Variation 3 is a further variation to Variation 2.

The pressurizing device 10 can calculate an average value of the position of the secondary transfer roller 25, and update the contact-position target profile with averaged position information. To calculate an average value of the position of the secondary transfer roller 25, for example, a FIFO (First In, First Out) storage area (a FIFO buffer) can be used.

That is, the pressurizing device 10 stores position information of the secondary transfer roller 25 detected at Step S403 in FIG. 14 sequentially in the FIFO buffer. The storage area can be provided in the storage unit 46 (see FIG. 6), or can be provided in a storage device other than the storage unit 46. Then, the pressurizing device 10 can update the contact-position target profile with multiple pieces of position information stored in the FIFO buffer.

Figures 15, 16:
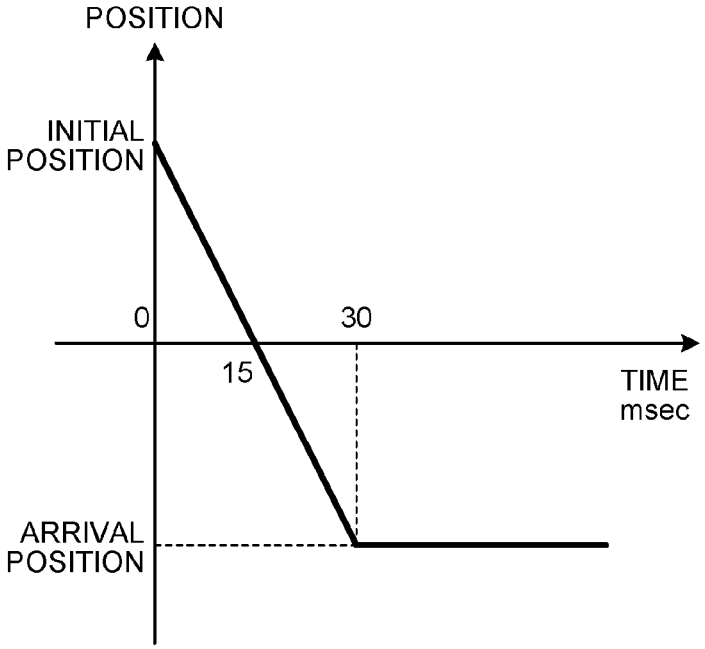
FIG. 15 is an explanatory diagram showing an example of source codes used when a FIFO buffer is implemented.
FIG. 16 is an explanatory diagram showing an example of a contact-position target profile.

FIG. 15 is an explanatory diagram showing an example of source codes used when the FIFO buffer is implemented. Here, ten moving averages using an average function are used as an example. If an average function taking a double variable as an argument is called, the FIFO buffer in the function stores therein signals of on to ten arguments and returns an average value of them as a return value.

This position signal (position information) is sent to the control unit 50 each time a sheet passes through the nip; therefore, for example, in a print setting of 60 print copies per minute, the signal is updated every second. At this time, when ten moving averages of second-by second signals are taken, signal components with 0.062 Hz or more contained in a signal, i.e. a signal with a shorter period than 16 seconds can be ignored. Accordingly, a noise component of a signal associated with the measurement can be efficiently removed.

Using the average value of position information calculated as above, the pressurizing device 10 sets a contact-position target profile used in contact control.

FIG. 16 is an explanatory diagram showing an example of the contact-position target profile. The initial position of the contact-position target profile is inevitably the separation position, and an average value of contact position obtained as described above is adopted in the arrival position. For example, a contact-position target profile in which the position moves from the initial position to the arrival position in about 30 milliseconds is set. The contact-position target profile is set so that, out of which, the position moves from the initial position to a position at which the distance d of the nip 70 is zero in about 15 milliseconds, and the position moves from the position at which the distance d is zero to the arrival position in about 15 milliseconds.

In this way, the pressurizing device 10 average the position information and updates the contact-position target profile, thereby can compose a finite impulse response filter. Therefore, the pressurizing device 10 can remove the influences of a measuring error and a time-dependent change that could be included when a contact-position target profile is created with one position information, and can improve the quality of a contact-position target profile. Accordingly, the pressurizing device 10 can stabilize the position of the secondary transfer roller 25 more quickly.

Second Embodiment

In the first embodiment, there is described a configuration in which the position of the supporting part 35 is displaced by using the translational actuator 37, and the driving-force detecting unit 42 detects (calculates) a driving force of the actuator 37 on the basis of characteristics of the translational actuator. In contrast with this, in a second embodiment, there is described a configuration in which the position of the supporting part 35 is displaced by using a rotary actuator 237 (i.e., a motor, see FIG. 17), and a driving force of the actuator 237 is detected (calculated) on the basis of characteristics of the motor.

Incidentally, any of the above-described variations of the first embodiment can be appropriately applied to the second embodiment.

Figure 17:
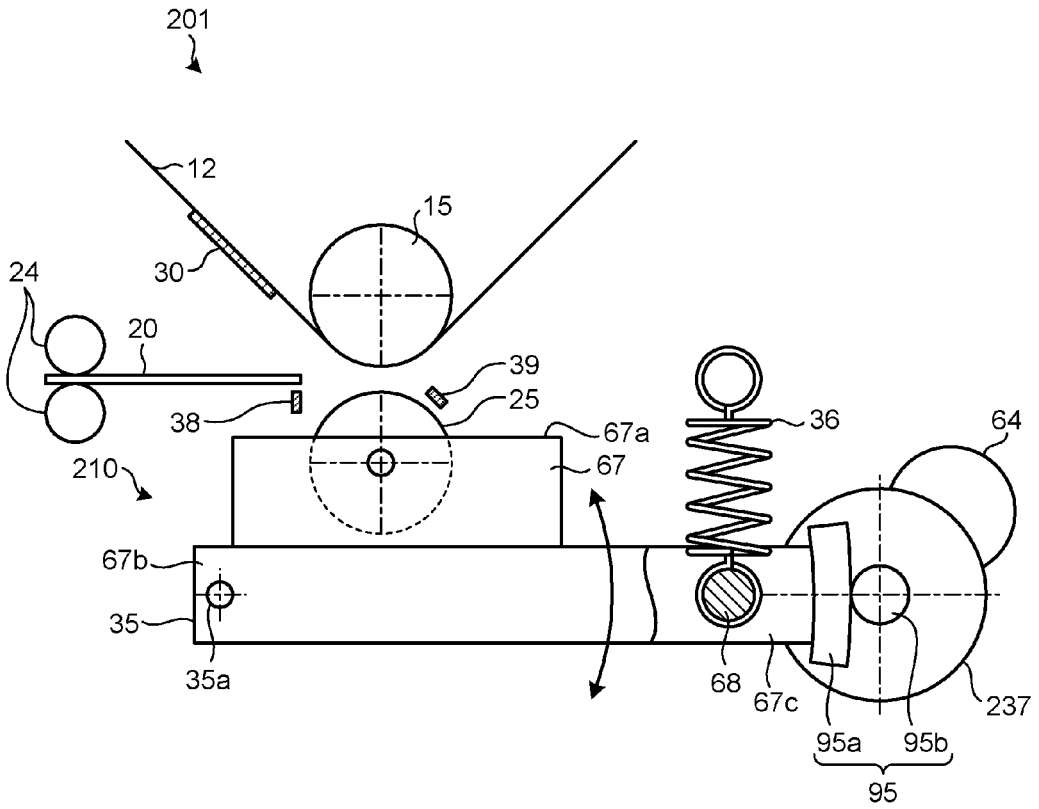
FIG. 17 is a diagram schematically showing a constructional example of a pressurizing device according to a second embodiment.

FIG. 17 is a diagram schematically showing a constructional example of a pressurizing device 210 according to the second embodiment. Incidentally, in FIG. 17, an image forming apparatus 201 including the pressurizing device 210 according to the second embodiment is schematically illustrated, and the image forming apparatus 201 is partially cut off. Illustration of the same component as that of the pressurizing device 10 according to the first embodiment may be omitted. Or, a component having the same function as in the first embodiment is assigned the same reference numeral, and description of the component may be omitted. Furthermore, components with the same reference numeral do not always share all the common function and property with each other, and can have a different function and property from each other according to each embodiment.

As shown in FIG. 17, the actuator 237 in the second embodiment is a rotary actuator; as a specific example, a general DC motor is used. Incidentally, the actuator 237 is not limited to this; for example, an AC motor can be used as the actuator 237. Furthermore, the actuator 237 can be either a motor with brush or a brushless motor. The actuator 237 can be another type of rotary actuator capable of torque control.

The rotating shaft 35*a* is placed on one end 67*b* of a support member 67. The actuator 237 is attached to the other end 67*c* of the support member 67 through a transmission mechanism 95. The transmission mechanism 95 has a gear 95*a* and a transmission gear 95*b*.

The gear 95*a* is formed on an end surface of the end. 67*c* of the support member 67. The transmission gear 95*b* is attached to a driving shaft of the actuator 237. Incidentally, the transmission gear 95*b* can be formed to be integrated with the driving shaft of the actuator 237.

When the actuator 237 is driven, the transmission gear 95*b* rotates in accordance with rotation of the driving shaft. The transmission gear 95*b* transmits torque of the actuator 237 to the supporting part 35 through the gear 95*a*. This swings the supporting part 35 around the rotating shaft 35*a* in accordance with a rotating direction of the driving shaft of the actuator 237.

The swing of the supporting part 35 causes the secondary transfer roller 25 to come close to or separate from the intermediate transfer belt 12. That is, the actuator 237 transmits the torque to the supporting part 35, thereby causing a force putting the secondary transfer roller 25 toward the intermediate transfer belt 12 or pulling the secondary transfer roller 25 away from the intermediate transfer belt 12 to act on the supporting part 35.

The configuration of the transmission mechanism 95 is not limited to the above. For example, the transmission mechanism 95 can be configured to transmit torque of the actuator 237 to the supporting part 35 by other means, such as friction, a belt, and wire.

The elastic body 36 is attached to a beam member 68 installed on the end 67*c* of the support member 67. The distance between the position of the elastic body 36 attached to the supporting part 35 and the rotating shaft 35*a* is shorter than the distance between the gear 95*a* and the rotating shaft 35*a*.

An encoder 64 is composed of a rotary encoder, and detects the rotation amount of the driving shaft of the actuator 237 and outputs an encoder pulse. The position detecting unit 41 (see FIG. 6) calculates displacement of the supporting part 35 from the rotation amount of the driving shaft of the actuator 237. Furthermore, the driving-force detecting unit 42 (see FIG. 6) detects (calculates) a current flowing through the actuator 237 and a driving force of the actuator 237 from a motor constant.

The control unit 50 (see FIG. 6) performs feedback control of the actuator 237 based on the position (displacement) of the supporting part 35, the speed of the supporting part 35, and the current flowing through the actuator 237. The functional configuration of the control unit 50 is the same as in the first embodiment.

The actuator 237 is a rotary actuator that is driven to rotate thereby causing a force to act on the supporting part 35. The actuator 237 is placed on the end 67*c* of the support member 67. Accordingly, a higher reduction ratio can be obtained, and a force pushing the secondary transfer roller 25 against the intermediate transfer belt 12 becomes greater with respect to a force that the actuator 237 causes to act on the supporting part 35.

Furthermore, a rotary actuator is generally more inexpensive than a direct-acting (translational) actuator used in the first embodiment. Accordingly, in the second embodiment, it is possible to reduce the manufacturing cost of the pressurizing device 210. Therefore, the compact, inexpensive actuator 237 can be used, which makes it possible to improve the degree of freedom in layout of the image forming apparatus 201 and reduce the manufacturing cost of the image forming apparatus 201. Furthermore, consumption energy of the image forming apparatus 201 is reduced.

Incidentally, the arrangement of the secondary transfer roller 25, the elastic body 36, the actuator 237, and the rotating shalt 35*a* in the second embodiment is not limited to that shown in FIG. 17. The configuration and placement of the pressurizing device 210 can be changed as long as the elastic body 36 can cause an intended force to act on the supporting part 35, and the actuator 237 can cause torque through an intended reduction ratio to act on the supporting part 35.

As explained above, according to the above embodiments, after the position of the repulsion roller 15 and the secondary transfer roller 25 is controlled, a feedback controlled object is switched from the position to force, and a force acting on between the repulsion roller 15 and the secondary transfer roller 25 is controlled so as to be a target value. In this way, the feedback control is performed in two stages; therefore, after the pair of rollers is quickly put into the contact state through the position control, the nip pressure can be fine-tuned by switching to control to the force control. Therefore, it is possible to control the nip pressure between the pair of rollers with high accuracy and high responsiveness, and possible to improve the image quality.

According to the present invention, first, the position of first and second rollers is controlled to bring the first and second rollers into the contact position, and then a feedback controlled object is switched from the position to force, and a force acting on between the first and second rollers is controlled so as to be a target value. In this way, the feedback control is performed in two stages; therefore, it is possible to control the nip pressure between the pair of rollers with high accuracy and high responsiveness.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

What is claimed is:

1. A pressurizing device comprising:

first and second rollers configured to hold a sheet-like medium with an image bearer formed on at least part of a surface of the medium between the first and second rollers and send the medium in a conveying direction while applying a pressure to the medium;

a driving unit configured to displace a position of at least one of the first and second rollers to make the first and second rollers come relatively closer to or relatively more separated from each other;

a position control unit configured to control the driving unit, and perform feedback control of the position of at least one of the first and second rollers;

a force control unit configured to control the driving unit, and perform feedback control of a force acting on the first and second rollers;

a control-method switching unit configured to switch, after the position of the first and second rollers is displaced from a relatively more separated separation position to a relatively closer contact position by the feedback control performed by the position control unit, a feedback controlled object so that the force becomes a target value of nip pressure through the feedback control performed by the force control unit; and a position detecting unit configured to detect the position of the second roller, wherein the driving unit is configured to displace the position of the second roller to make the first and second rollers come relatively closer to or relatively more separated from each other, the position control unit is configured to perform feedback control of the position of the second roller based on a difference between a contact-position target profile defining time transition of a target position of the second roller in response to the first and second rollers being put into a relatively closer contact position and a result of detection by the position detecting unit, and in response to the position of the second roller detected by the position detecting unit at the target position defined in the contact-position target profile, the control-method switching unit is configured to switch from the feedback control performed by the position control unit to the feedback control performed by the force control unit.

2. The pressurizing device of claim 1, further comprising an entry detecting unit configured to detect an entry of the medium into a nip between the first and second rollers, wherein in response to the entry detecting unit detecting the entry of the medium into the nip in a state where the first and second rollers are in a relatively more separated position, the control-method switching unit is configured to cause the position control unit to put the first and second rollers into a relatively closer contact position, and then is configured to cause the force control unit to set a nip pressure between the first and second rollers as the target value.

3. The pressurizing device of claim 2, further comprising an escape detecting unit configured to detect the escape of the medium from the nip, wherein in response to the escape detecting unit detecting the escape of the medium from the nip in a state where the first and second rollers are in a relatively closer position, the control-method switching unit is configured to cause the position control unit to put the first and second rollers into a relatively more separated position.

4. The pressurizing device of claim 1, wherein in response to the position of the second roller detected by the position detecting unit becoming stabilized at the target position defined in the contact-position target profile, the position control unit is configured to store a driving force of the driving unit when the position becomes stabilized in a storage unit, and the force control unit is configured to determine a driving force after switching from the feedback control performed by the position control unit to the feedback control performed by the force control unit based on the driving force stored in the storage unit.

5. The pressurizing device of claim 1, wherein the position detecting unit is configured to detect the position of the second roller at an end of contact control of the first and second rollers performed by the force control unit, and the position control unit is configured to update the contact-position target profile by using the position of the second roller detected by the position detecting unit at the end of the contact control, and is configured to perform feedback control of the driving unit by using the updated contact-position target profile in response to the first and second rollers being brought into a next relatively closer contact position.

6. The pressurizing device of claim 5, wherein before the end of the contact control, the position detecting unit is configured to detect a position history of the second roller thereby storing a plurality of position information in the storage unit, and the position control unit is configured to update the contact-position target profile based on the plurality of position information stored in the storage unit.

7. An image forming apparatus, comprising the pressurizing device of claim 1.

8. A pressurizing device comprising:

first and second rollers configured to hold a sheet-like medium with an image bearer formed on at least part of a surface of the medium between the first and second rollers and send the medium in a conveying direction while applying a pressure to the medium;

a driving unit configured to displace a position of at least one of the first and second rollers to make the first and second rollers come relatively closer to or relatively more separated from each other;

a position control unit configured to control the driving unit, and perform feedback control of the position of at least one of the first and second rollers;

a force control unit configured to control the driving unit, and perform feedback control of a force acting on the first and second rollers;

a control-method switching unit configured to switch, after the position of the first and second rollers is displaced from a relatively more separated separation position to a relatively closer contact position by the feedback control performed by the position control unit, a feedback controlled object so that the force becomes a target value of nip pressure through the feedback control performed by the force control unit; and a force detecting unit configured to detect a force acting on the first and second rollers, wherein the force control unit is configured to perform feedback control of the force acting on the first and second rollers on the basis of a difference between a force target profile defining time transition of a target value of force acting on the first and second rollers in response to the first and second rollers being put into a relatively closer contact position and a result of detection by the force detecting unit.

9. An image forming apparatus, comprising the pressurizing device of claim 8.

10. A control method performed by a pressurizing device, the pressurizing device including:

first and second rollers configured to hold a sheet-like medium with an image bearer formed on at least part of a surface of the medium between the first and second rollers and send the medium in a conveying direction while applying a pressure to the medium; and a driving unit configured to displace the position of at least one of the first and second rollers to make the first and second rollers come relatively closer to or relatively more separated from each other, and a position detecting unit configured to detect the position of the second roller the control method comprising:

controlling the driving unit and performing feedback control of the position of at least one of the first and second rollers;

controlling the driving unit and performing feedback control of a force acting on the first and second rollers; and switching, after the position of the first and second rollers is displaced from a relatively more separated separation position to a relatively closer contact position through position control, a feedback controlled object so that the force becomes a target value of nip pressure through the feedback control of force control;

displacing, via the driving unit, the position of the second roller to make the first and second rollers come relatively closer to or relatively more separated from each other, performing feedback control of the position of the second roller based on a difference between a contact-position target profile defining time transition of a target position of the second roller when the first and second rollers are put into a relatively closer contact position and a result of detection by the position detecting unit; and switching, in response to the position of the second roller detected by the position detecting unit at the target position defined in the contact-position target profile, from the feedback control of the position to the feedback control of control of the force.

11. The control method of claim 10, further comprising detecting a force acting on the first and second rollers, wherein the feedback control of the force acting on the first and second rollers is performed on the basis of a difference between a force target profile defining time transition of a target value of force acting on the first and second rollers when the first and second rollers are put into a contact state and a result of detection of force acting between the first and second rollers.

12. The control method of claim 10, further comprising storing, in response to the detected position of the second roller becoming stabilized at the target position defined in the contact-position target profile, a driving force of the driving unit when the position becomes stabilized, and determining a driving force, after switching from the feedback control of the position control to the feedback control of the force, based on the stored driving force.

13. The control method of claim 10, further comprising detecting the position of the second roller at an end of contact control of the first and second rollers, updating the contact-position target profile using the detecting position of the second roller at the end of the contact control, and performing feedback control of the position by using the updated contact-position target profile when the first and second rollers are brought into a next relatively closer contact position.

14. The control method of claim 13, further comprising detecting, before the end of the contact control, a position history of the second roller and storing a plurality of position information as the position history, and updating the contact-position target profile based on the stored plurality of position information.

* * * * *